US008312592B2

(12) United States Patent
Voorhorst et al.

(10) Patent No.: US 8,312,592 B2
(45) Date of Patent: Nov. 20, 2012

(54) CLEANING APPARATUS FOR RELEASING AND TRANSPORTING PARTICLES AWAY FROM AN AREA TO BE CLEANED

(75) Inventors: Fokke R. Voorhorst, Drachten (NL); Johan Pragt, Drachten (NL); Freddy Moes, Hoogeveen (NL); Jan Hans Benedictus, Beetserzwaag (NL); Lorcan Jarlath Kemple, Galway (IE)

(73) Assignee: Koninklijke Philips Electronics N.V., Eindhoven (NL)

( * ) Notice: Subject to any disclaimer, the term of this patent is extended or adjusted under 35 U.S.C. 154(b) by 533 days.

(21) Appl. No.: 11/909,830

(22) PCT Filed: Mar. 24, 2006

(86) PCT No.: PCT/IB2006/050911

§ 371 (c)(1), (2), (4) Date: Sep. 27, 2007

(87) PCT Pub. No.: WO2006/103610

PCT Pub. Date: Oct. 5, 2006

(65) Prior Publication Data

US 2008/0201899 A1 Aug. 28, 2008

(30) Foreign Application Priority Data

Apr. 1, 2005 (EP) ..... 05102595

(51) Int. Cl.
*A47L 5/14* (2006.01)
*A47L 9/10* (2006.01)
*A47L 9/20* (2006.01)

(52) U.S. Cl. ..... 15/346; 15/349

(58) Field of Classification Search ..... 15/346, 15/349, 356

See application file for complete search history.

(56) References Cited

U.S. PATENT DOCUMENTS

| | | | | |
|---|---|---|---|---|
| 1,056,819 | A * | 3/1913 | Norwood et al. | 15/350 |
| 2,415,372 | A * | 2/1947 | Salt et al. | 15/43 |
| 3,075,227 | A * | 1/1963 | Bowles | 15/346 |
| 3,257,681 | A * | 6/1966 | Miller | 15/331 |
| 3,903,564 | A * | 9/1975 | Morinaga | 15/344 |
| 4,044,245 | A | 8/1977 | Mabuchi | |
| 4,109,341 | A | 8/1978 | Larsen et al. | |
| 4,204,298 | A * | 5/1980 | Handa et al. | 15/344 |
| 4,466,156 | A | 8/1984 | Blehert | |
| 4,571,849 | A * | 2/1986 | Gardner et al. | 34/79 |
| 4,951,347 | A | 8/1990 | Star et al. | |
| 6,237,188 | B1 | 5/2001 | Takemoto et al. | |
| 6,719,830 | B2 * | 4/2004 | Illingworth et al. | 95/270 |
| 6,772,472 | B2 * | 8/2004 | Wang | 15/344 |
| 2002/0084218 | A1 | 7/2002 | Illingworth | |
| 2006/0213025 | A1 * | 9/2006 | Sawalski | 15/344 |

FOREIGN PATENT DOCUMENTS

JP 07327888 A 12/1995

* cited by examiner

*Primary Examiner* — Bryan R Muller

(57) ABSTRACT

The invention relates to a cleaning apparatus (10) for releasing and transporting particles away from an area to be cleaned, comprising: a housing (6) having an opening (8) to be positioned on an area (1) to be cleaned;—a member that is movable within the apparatus for generating an airflow to release and transport particles away from the area; wherein the member comprises an airflow-generating surface (12) arranged within the housing (6), said airflow-generating surface in its operating condition lacing the area (1) to be cleaned and having a direction of movement that is substantially parallel to said area so as to cause an airflow parallel to said area. The apparatus according to the invention requires less energy for releasing and transporting particles away from an area to be cleaned.

7 Claims, 3 Drawing Sheets

CLEANING APPARATUS FOR RELEASING AND TRANSPORTING PARTICLES AWAY FROM AN AREA TO BE CLEANED

The present invention relates to a cleaning apparatus for releasing and transporting particles away from an area to be cleaned, comprising:

a housing having an opening that is to be positioned on an area to be cleaned;

a member that is movable within the apparatus for generating an airflow to release and transport particles away from the area.

A cleaning apparatus for releasing and transporting particles as described in the first paragraph is known, for example, from the patent application US 2002/0084218 A1. This document discloses an improved vacuum cleaner that utilizes a cylindrical toroidal vortex flow to release and transport dust particles. The air flow is established by means of an impeller and is used to release and transport the dust particles either along an inner shroud or through an inner tube that is disposed between the impeller and an endface of the housing facing the area to be cleaned. In the arrangement with said inner tube, the particles that have been released and transported trough the tube are thrown against the circular side wall of a dust collector by the centrifugal action of the air flow. The air is subsequently delivered towards the area to be cleaned via an outer tube surrounding the inner tube.

A problem with this known apparatus is that its power consumption is relatively high. This is mainly caused by the pressure difference that needs to be created by the impeller in order to transport the particles that are being released along the inner shroud or within the inner tube, as applicable.

It is an object of the present invention to provide a cleaning apparatus that requires less energy for releasing and transporting particles away from an area to be cleaned.

According to the present invention, the objects mentioned in the previous paragraphs are achieved by means of a cleaning apparatus for releasing and transporting particles away from an area to be cleaned according to the preamble of claim 1, wherein the member comprises an airflow-generating surface arranged within the housing, said airflow-generating surface facing the area to be cleaned in the operating condition and having a direction of movement that is substantially parallel to said area so as to cause an airflow parallel to said area.

The airflow as created by the moving airflow-generating surface will thus show a strong gradient of airflow velocity, seen in the vertical direction (i.e. perpendicular to the area to be cleaned). In this case the velocity at or close to the area to be cleaned will be substantially zero, while a maximum airflow velocity is present at the airflow-generating surface. This gradient will cause the particles to become detached from the area and transported away from there in the direction of the airflow owing to the so-called Bernoulli principle, which will be discussed later in more detail. By contrast, the apparatus as disclosed in US 2002/0084218 A1 establishes a clear pressure difference to release and transport the dust particles in a vertical direction, e.g. a pressure difference between the housing and the dust collection system for transportation through the inner tube.

According to the present invention, it is important that under operating conditions there are practically no components of the cleaning apparatus located in the space between the airflow-generating surface and the area with particles thereon, or at least as few as possible, since this would unduly disturb the airflow that needs to be established.

In cleaning an area according to the invention, it is not necessary to create pressure differences or a substantial under pressure, at least not to such an extent as is characteristic of known vacuum cleaners or other known cleaning apparatuses. According to the invention, the airflow for releasing and transporting the particles will encounter less friction owing to the absence of components like filters, dust bags, and long tortuous hoses. Furthermore, components touching the area with particles, such as a sweeping brush, are not required. The invention thus provides a cleaning apparatus that consumes less energy. Moreover, since the member or airflow-generating surface can operate at a lower speed, the noise produced by the apparatus will be less. A lower noise level is also promoted by the lesser amount of friction that is encountered by the airflow, as mentioned above. Another consequence is that the apparatus renders possible a simpler construction, since components used for transporting released particles, such as, for example, a hose leading to a separate chamber of the apparatus, are not required with the present invention. According to the invention, an airflow is created that has an optimum effect with respect to releasing and transporting particles away from an area.

It should be noted that a cleaning apparatus comprising one or more brushes that rotate substantially parallel to an area to be cleaned is not part of the present invention, since such a brush in only capable of releasing particles from an area to be cleaned, while the rotating action of the brush generally is not sufficient to transport the particles away from this area. This means that such transport of particles cannot be obtained by the brush alone. The ends of the hairs of a rotating brush therefore cannot constitute an airflow-generating surface according to the present invention. Of course it is possible to add a cleaning brush to an apparatus according to the present invention, as will be explained in more detail below.

The feature from claim 1 "Said airflow-generating surface ( . . . ) having a direction of movement that is substantially parallel to said area", denotes any movement of the airflow-generating surface which creates an airflow that moves substantially parallel to the area with particles. Thus a slightly inclining movement of the airflow-generating surface is also included in this feature.

According to a preferred embodiment of the cleaning apparatus, the airflow-generating surface is rotatable within the housing so as to cause a rotating airflow parallel to the area to be cleaned. This embodiment provides the simplest practical construction for the movable components of the apparatus. By contrast, a conveyor belt type of construction, for example, needs at least two rotating parts. Moreover, this embodiment will allow a flatter design of the apparatus, which is beneficial for entering spaces of limited height, for example spaces under furniture.

According to another embodiment, the airflow-generating surface is provided on a rotatable disc or provided on rotor blades, which in the operating condition extend towards the area to be cleaned. A rotating disc will provide a maximum impact with respect to setting the surrounding air in motion in contrast to, for example, rotating elongated spokes or bars. If rotor blades are used, the airflow-generating surface being formed by the rotor blades, it was found that the air velocity close to the area with particles increases, which causes an increase in kinetic energy that is imposed on the particles that are released. Furthermore, a considerable increase in this kinetic energy was observed to be caused by the numerous impacts between the blades and the particles.

According to the invention, it is preferred that a particle collector is provided for collecting the particles that were released from the area. It may be, however, that one just wants to transport particles from one location to another, and thus the concept of the invention is not necessarily restricted to apparatuses provided with such a particle collector. However, it is most likely that one wants to have the opportunity to collect the particles that have been released and transported, which is made possible in that a particle collector is provided.

For embodiments having a particle collector, it is preferred that this particle collector is disposed within the housing, which allows a more compact design and a simpler manner of collecting the particles. Moreover, the particles need only to travel over a small distance in this manner, which is advantageous for energy consumption. The particle collector preferably comprises a wall that surrounds the airflow-generating surface, said wall rotating in the same direction as the airflow-generating surface in the operating condition. The rotating airflow will cause the particles that have been released to be transported in an outward direction because of the centrifugal forces. These particles will be collected and retained at such a wall if this wall surrounds the airflow-generating surface and rotates in the same direction therewith. More preferably, this wall is circular and comprises a flange, which flange extends from a lower edge portion of the circular wall towards the axis of rotation thereof. Upon shutting down of the rotating movement of the wall, the particles will no longer be retained by the wall but will drop under the influence of gravity. A flange that extends from a lower edge portion may be provided to collect the dropping particles, from which flange they can be removed later.

Another preference is that the particle collector comprises a chamber, which is mounted to the airflow-generating surface, a bottom surface of the chamber facing away from the airflow-generating surface, while a duct is provided comprising guiding means and having an opening towards the chamber and an opening towards the airflow-generating surface for transporting the particles to the chamber. The released particles travel through the duct owing to the kinetic energy imposed on them, are guided by the guiding means, and are subsequently collected at the bottom wall of the chamber. It is preferred that the duct is annular and that the opening of the duct towards the airflow-generating surface is annular and surrounds said surface, while the duct further comprises guiding means comprising an elongated projection that extends spirally along an outer wall of the duct. In this case the rotating particles that hit the outer wall of the duct are forced to follow a contact surface of the projection and travel through the duct towards the collection chamber.

It is preferred in embodiments as described in the previous paragraph that a bottom wall of the chamber comprises a flexible part and that an opening is provided in the bottom wall and in the airflow-generating surface, while the flexible part allows a deflection of the bottom wall from a retaining position, in which the bottom wall of the chamber extends in an upward direction towards the opening for collecting and retaining particles, into a releasing position, in which the bottom wall of the chamber extends in a downward direction towards the opening for releasing particles. Such a construction provides a simple method of emptying the collection chamber by flipping the bottom wall thereof. After deflection into a releasing position, the particles that have been collected in the chamber will automatically drop through the opening from the chamber due to gravity. When the chamber has been emptied, the bottom wall is flipped back, so that the apparatus is ready for use again. More preferably, the flexible part comprises a ring of flexible material, such as a rubber ring. This construction provides a simple and effective method for creating a flexible bottom wall. Even more preferably, handling means are provided in this case that facilitate deflection from the retaining position into the releasing position. Such handling means will facilitate the actuation of the deflection movement of the bottom wall.

According to a preferred embodiment, the housing has a circumferential edge surrounding the opening, said edge, in an operating condition, contacting the surface of the area to be cleaned and substantially closing the opening of the housing, thereby creating a substantially closed space defined by the housing and the surface of the area to be cleaned. This is mainly advantageous in the case of a soft surface, such as a carpet, since the edge will at least partly open up or separate neighboring carpet fibers when the housing is moved over the carpet, thereby facilitating the release of particles. This effect will occur especially if the edge is sharp. Furthermore, this embodiment prevents air from leaking from the housing, which effect occurs with both hard and soft surfaces. Prevention of such air leaks causes a more effective airflow within the housing.

Alternatively to the embodiment as described in the previous paragraph, it is advantageous when the housing has a circumferential edge comprising a plurality of baffles that are distributed along a perimeter of the edge, wherein each baffle extends in downward direction away from the edge and has a bouncing surface for bouncing off the particles carried by the airflow, the bouncing surface being positioned obliquely in relation to the perimeter of the edge for preventing particles from escaping from the housing.

The positioning of the bouncing surface is such that particles bounce back towards the inside of the housing instead of continuing their outward movement and leaving the housing before being collected. These types of edges are mainly advantageous for hard surfaces, such as wooden or concrete floors. In this case the baffles will guide particles present outside the housing towards the interior thereof by moving over the area while at the same time keeping the particles present within the housing inside. More preferably, with such a circumferential edge, each bouncing surface is positioned obliquely in relation to a vertical direction parallel to the axis of rotation, so as to bounce particles hitting the baffles upward towards the interior of the housing instead of downward towards the area to be cleaned.

Some important terms in this disclosure are clarified below with respect to their proper interpretation.

With "particles" is meant in this disclosure any type of particle or part that one want to remove form an area to be cleaned, which may include both smaller and larger particles, dust particles, sand, bacteria, hairs, paper fragments, etc. It also includes particles that comprise liquid or gas, such as water droplets.

By "downward" is meant in this disclosure any direction leading towards the area with particles to be cleaned, when the cleaning apparatus according to the invention is in its operating condition.

By "upward" is meant in this disclosure any direction leading away from the area with particles to be cleaned, when the cleaning apparatus according to the invention is in its operating condition.

By "outward" is meant in this disclosure any direction regarding a rotating member according to the invention that leads away from the corresponding axis of rotation.

The invention will be explained in more detail below with reference to the accompanying drawings, in which.

Figure 1:
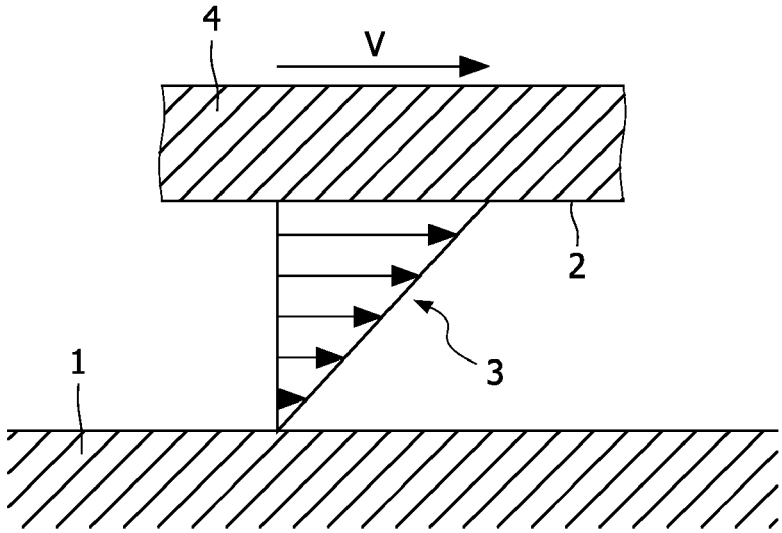
FIG. 1 is a schematic drawing illustrating the principle of the invention.

FIG. 1 is meant to illustrate the principle of the invention. When a particle lies on a surface, the creation of an airflow over this surface can release it. The mechanism of particle release is rather complicated. A horizontal displacement of a particle arises from the fact that an overpressure is built up in front of a particle because the airflow is locally impeded by the particle. Behind it an under pressure is created, causing a pressure difference that leads to a horizontal displacement of the particle. A vertically directed force on the particles arises from the Bernoulli effect. At the top of the particle the airflow has a certain velocity, whereas this velocity is virtually zero at the bottom of the particle. This difference in airflow velocities creates a pressure difference that lifts up the particle. Thus it suffices to provide an airflow in order to release and transport particles.

An airflow is traditionally created by establishing a pressure difference. This can be done by means of a nozzle or a tube, a lower pressure being created at one end of the tube, for example, by means of a rotor, which causes an airflow through the tube or nozzle.

According to the invention, the airflow is created in an alternative manner. FIG. 1 shows an area 1 containing particles of any kind (not shown) and a movable member 4. The moveable member 4 has an airflow-generating surface 2 that faces the surface with particles. The airflow-generating surface 2 and the member 4 move substantially parallel to the area 1 with particles at a certain speed v. This movement of surface 2 will cause an airflow that is directed parallel to the opposing area 1 and is characterized by an air velocity distribution 3. This airflow suffices to release and transport the particles away from area 1, without any necessity to establish any pressure differences in the space between area 1 and airflow-generating surface 2. Here the only moving part is a wall or a surface of the space from where particles are to be removed, this wall or surface acting as it were as a pump that brings about the required airflow.

Figure 2:
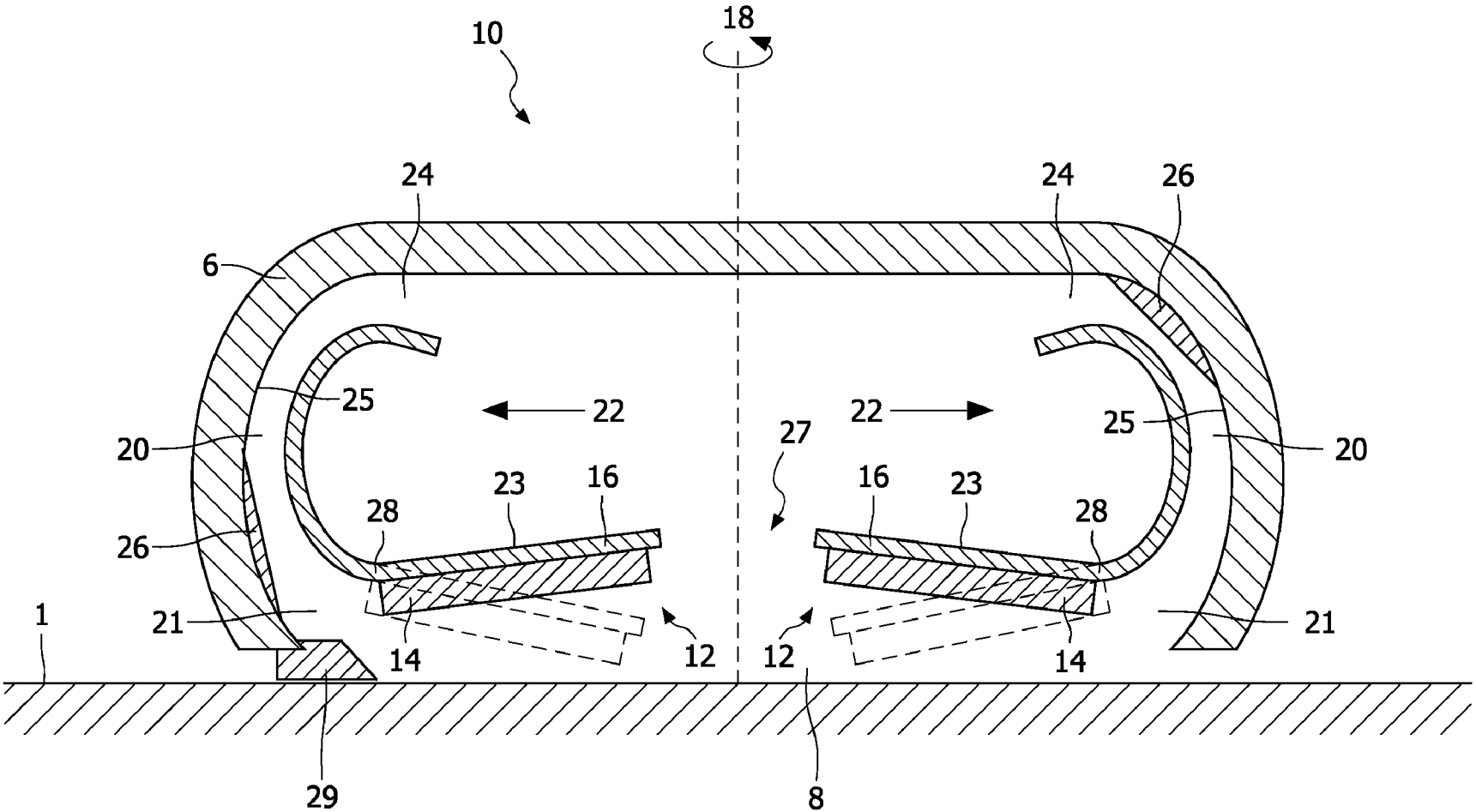
FIG. 2 is a schematic cross-section of a cleaning apparatus for releasing and transporting particles away from an area to be cleaned according to a first preferred embodiment of the invention.

Referring now to FIG. 2, which shows a first preferred embodiment of the invention, a cleaning apparatus for releasing and transporting particles 10 is schematically depicted. The apparatus comprises a housing 6 having an opening 8, the housing being positioned on the area with particles 1. Preferably, the housing 6 has a substantially circular shape. A member of the apparatus is shown only partly in FIG. 2 and comprises a disc 16 that is rotatable within the housing 6 about an axis 18. The disc comprises rotor blades 14 that extend towards the area with particles 1. The surfaces of the blades and the disc 16 facing the area with particles together form an airflow-generating surface 12. The rotating movement of the member causes a rotating airflow within the housing 6, which is brought about by the airflow-generating surface 12, the airflow causing the release and transport of the particles lying on area 1.

In a special preferred embodiment that is not shown in any of the drawings, the rotating member comprises rotor blades connected to a shaft, while no rotating disc is present. The rotor blades in this case preferably extend substantially perpendicularly to the area to be cleaned.

A particle collector comprising a chamber 22 is provided, a bottom surface 23 of the chamber facing away from the airflow-generating surface 12. The corresponding bottom wall of the chamber coincides with the disc 16, the chamber 22 rotating along with the disc. Instead of integrating the disc and a bottom wall of the dust-collecting chamber, it is possible to mount one component to the other in a manner know per se. Furthermore, it possible to interconnect the two components by means of a gear train, so that the chamber and the disc rotate at different speeds.

An annular duct 20 is provided between the housing 6 and the chamber 22. The duct 20 has an opening 21 towards the airflow-generating surface and an opening 24 towards the chamber 22. The opening towards the airflow-generating surface is annular and surrounds said surface. "Annular duct" in this case denotes that the duct surrounds the airflow-generating surface and the chamber. It does not mean that this duct has a circular cross-section. An outer wall thereof, for example, may have a triangular cross-section. Centrifugal forces caused by the rotating airflow cause the particles to travel in outward direction and to enter duct 20 via opening 21. In the duct, guiding means are arranged, which comprises an elongated projection 26 that extends spirally along an outer wall 25 of the duct 20. The projection here spirals upwards. After entering the duct the particles subsequently travel through the duct, wherein they are guided in upward direction by means of the elongated projection 26 until they enter the chamber 22 via opening 24. It was found that the kinetic energy imposed on the particles by the air flow and the impacts with the rotor blades are sufficient for them to reach the chamber via the duct. The chamber serves to collect the particles.

FIG. 2 further shows that an opening 27 is provided in the bottom wall as well as in the airflow-generating surface 12. Preferably, the opening 27 is provided in a central part of the bottom wall and the airflow-generating surface 12. The bottom wall 16 of the chamber 22 comprises a flexible part 28 allowing a deflection of the bottom wall from a retaining position, in which the bottom wall of the chamber extends in an upward direction towards the central opening for collecting and retaining the particles, into a releasing position, in which the bottom wall of the chamber extends in a downward direction towards the central opening for releasing the particles. In the releasing position the collected particles will drop from the chamber 22 through the opening 27. The dotted lines in FIG. 2 indicate the bottom wall together with the rotor blades in the releasing position.

Preferably, the flexible part comprises a ring of flexible material, such as a rubber ring, which ring will provide for the deflection movement. Furthermore, handling means are provided for facilitating deflection from the retaining position and the releasing position. Such handling means may comprise an actuating knob, preferably disposed at the outside of the housing, which knob actuates a bar that exerts a downward force on the bottom wall of the chamber in order to achieve a deflection thereof. Alternatively, a handle extending in a downward direction away from the airflow-generating surface may be provided.

The features relating to the switching movement of the bottom wall as mentioned in the previous paragraphs may also be applied in other apparatuses and cleaning appliances and are therefore not restricted to apparatuses as defined in claim 1. In fact, any cleaning apparatus with a circular collecting chamber will benefit from this construction.

The shaft that drives the rotating member is not shown in FIG. 2, but it may either be disposed completely in the housing or extend through an opening therein. The connection between the shaft on the one hand and the chamber, disc, and rotor blades on the other hand can be made by means of a spoke-construction, the spokes extending between the shaft and the chamber.

Finally, FIG. 2 shows a baffle 29. The housing preferably comprises a plurality of baffles that are distributed along a circumferential edge thereof. The baffles will be explained in more detail below.

The top wall of the housing 6 in FIG. 2 is straight, but it may alternatively be arranged to partially follow the contour of the chamber in order to get a more compact and rounded design.

Figure 3:
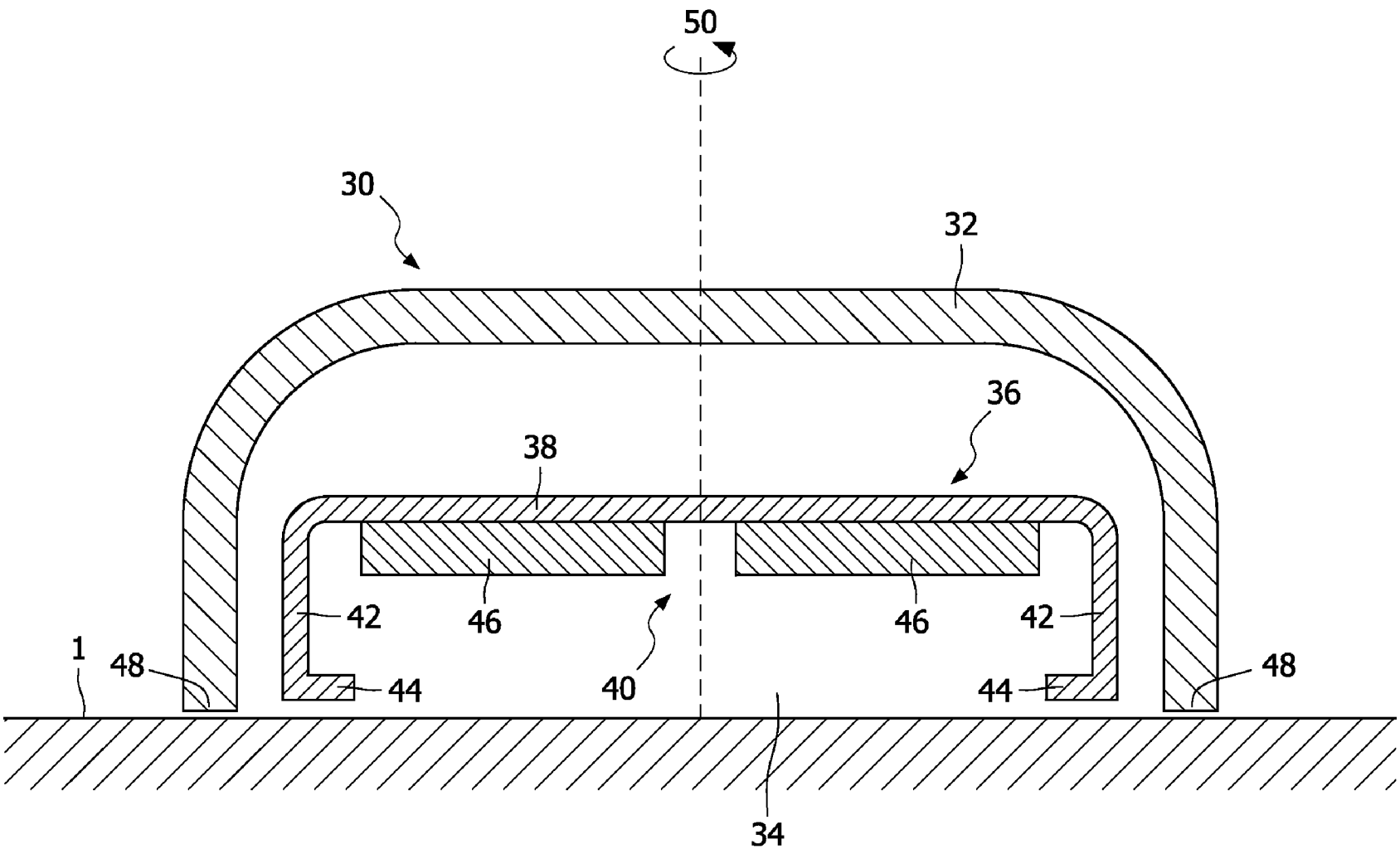
FIG. 3 is a schematic cross-section of a cleaning apparatus for releasing and transporting particles away from an area to be cleaned according to another preferred embodiment of the invention.

Referring now to FIG. 3, which shows another preferred embodiment of the invention, a cleaning apparatus for releasing and transporting particles 30 is schematically depicted. Similar to the embodiment shown in FIG. 2, the apparatus 30 comprises a housing 32 having an opening 34 that is positioned on the area with particles 1. Preferably, the housing 32 has a substantially circular shape. A member 36 comprises a disc 38 and is rotatable within the housing 32 about an axis 50. The disc comprises rotor blades 46 that extend towards the area with particles 1. It is alternatively possible, however, to apply only a disc or only rotor blades. The surfaces of the rotor blades 46 and of the disc facing the area with particles together form an airflow-generating surface 40. The rotating movement of the member 36 causes a rotating airflow within the housing 32, which is brought about by the airflow-generating surface 40 and causes a release and transport of the particles lying on the area 1.

The apparatus 30 further comprises a particle collector, which consists of a wall 42 that surrounds the airflow-generating surface and is connected to the disc 38 in the embodiment shown. The wall 42 when in the operating condition, therefore, rotates in the same direction as the airflow-generating surface 40. The particles will travel in outward direction due to the centrifugal forces created by the airflow. When the particles hit the wall 42 they will be collected and retained there, since this wall rotates as well. Preferably, the wall rotates in the same direction as the airflow-generating surface, but an opposite direction of rotation is also possible.

It can be seen in FIG. 3 that the circular wall 42 comprises a flange 44, which flange extends from a lower end portion of the wall towards the axis of rotation thereof. When the rotating movement of the wall and the airflow-generating surface shuts down, the particles that are retained by the wall will drop down under the influence of gravity and are collected on the flange 44, from where they can be removed later.

The housing 32 in FIG. 3 has a circumferential edge 48 surrounding its opening, said edge contacting the surface of the area to be cleaned 1 and substantially closing the opening 34 of the housing, thereby creating a substantially closed space defined by the housing and the area to be cleaned. This prevents air from leaking into the housing, causing a more effective airflow within the housing.

Preferably, a sharp-edged housing is used, which clearly does not apply to the edge 48 shown in FIG. 3. It is mainly advantageous in the case of a soft surface, such as a carpet, where the edge will at least partly open or separate neighboring carpet fibers when the housing is moved over the carpet, thereby facilitating the release of particles.

Figure 4:
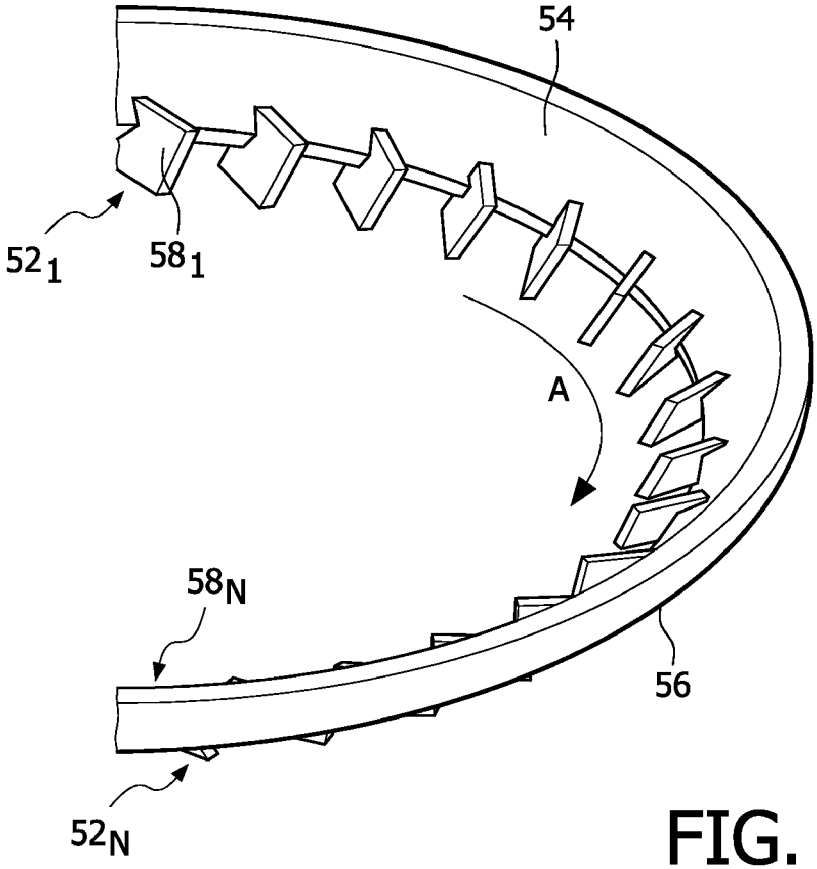
FIG. 4 is a perspective view of part of a preferred embodiment of the circumferential edge of a cleaning apparatus according to the invention.

FIG. 4 is a perspective view of part of a preferred embodiment of the circumferential edge 54 of an apparatus according to the invention. This edge corresponds to the edge of the housing 6 facing the area with particles 1 from FIG. 2. FIG. 4 only shows the edge itself for reasons of clarity. In this Figure a plurality of baffles $\mathbf{52}_1$-$\mathbf{52}n$ can be seen that are distributed along a perimeter 56 of the edge, each baffle extending downward from the edge and having a bouncing surface $\mathbf{58}_1$-$\mathbf{58}n$ for bouncing off the particles carried by the airflow. It can be seen that the bouncing surfaces $\mathbf{58}_1$-$\mathbf{58}_n$ are positioned obliquely in relation to the perimeter 56 of the edge 54. They are positioned in relation to the direction of rotation of the airflow indicted by arrow A in FIG. 4 such that they will prevent particles from escaping from the housing. The positioning of the bouncing surface is such that particles bounce back towards the inside of the housing instead of continuing their outward movement and leaving the housing before being collected.

FIG. 4 also shows that each bouncing surface is positioned slightly obliquely in relation to a vertical direction, which is parallel to the axis of rotation (not shown). The particles hitting the baffles will thus bounce upward towards the interior of the housing instead of returning to the area to be cleaned.

Although not illustrated in any of the drawings, it is preferred to provide a filter somewhere in the chamber or space in which the particles travel toward the dust collector, or in the dust collector itself, which filter is stationary in relation to the rotating collector and other rotating parts. Such a filter is meant to restrain the larger, heavier particles from entering the rotating collector or rotating chamber, which could otherwise be hampered in its rotating movement by an unbalanced weight distribution.

In FIGS. 2 and 3, the particle collector is directly mounted to the rotating member or coincides therewith. It is conceivable, however, to connect the dust collector to the axis of rotation of the rotating member by means of a gear train.

Although this is not illustrated in any of the drawings, it is preferred that a central space between the airflow-generating surface and the area with particles, for example the space under the central opening 27 in FIG. 2, comprises cleaning tools. Appropriate cleaning tools may be, for example, cleaning pads, polishing pads, or a rotating brush. These tools provide an additional cleaning function, which regarding their positioning will always be combined with the main function of releasing and transporting particles. They are preferably designed so as to be removable or replaceable by hand.

The embodiments shown in FIGS. 2 and 3 are particularly suitable for use in a hand-held cleaning apparatus, which can be operated single-handed. Since such an apparatus uses less energy than cleaning apparatuses in the prior art, it can be equipped with, for example, a small electric motor that runs on batteries. In this case substantially all components or at least the larger ones can be accommodated within the corresponding housing. Preferably, the housing has a substantially circular shape in this case. Typical sizes of the outer diameter of the housing lie in a range of 10 to 25 cm. Typical weights of such cleaning appliances lie in a range of 200 to 1500 g. Preferred materials are plastics, such as polypropene (PP), acrylonitrile butadiene styrene (ABS), or polycarbonate (PC).

Furthermore, it is preferred that the airflow-generating surface is substantially circular in shape and rotates within the housing. The airflow-generating surface preferably moves at a substantially constant rotation speed, at least under normal operating conditions. However, an airflow-generating surface that is part of a conveyer belt type construction is also possible. Even a surface or a plate performing reciprocating movements over the area with particles will work if it is the object to transport the particles to two mutually opposed sides.

For ease of handling it is possible to connect an elongated handle to the housing, preferably by means of a hinged connection. Furthermore, a downward force can thereby be exerted on the housing, which is advantageous for preventing air leaks from the housing, especially in embodiments without baffles.

Normally, a dust collector will be disposed within the housing, as is the case in the embodiments shown in FIGS. 2 and 3. It is possible, however, to dispose a dust collector outside the housing. For example, a housing with openings may be used, the openings being in communication with the dust collector. It is alternatively possible, for example, to use two or more housings that are substantially circular in shape and are mutually connected in one line, the respective airflows communicating with each other, while only the central housing comprises a dust collector.

Although preferred embodiments have been described above, many modifications will immediately suggest themselves to those skilled in the art. For example, the embodiment illustrated in FIG. 2 may also be constructed without baffles 29 but with a circumferential edge 48 as shown in FIG. 3. These modifications fall within the scope of the invention as defined by the appended claims. Also a number of technical features that have been separately illustrated and described may be combined, these combinations also falling within the scope of the invention. For example, it is possible to combine the circular wall 42 from the embodiment of FIG. 3 with the collection chamber 22 and the annular duct 20 of FIG. 2.

The invention claimed is:

1. A cleaning apparatus for releasing and transporting particles from an area to be cleaned, comprising:

a housing having a first opening that is to be positioned on an area to be cleaned;

a member that is rotatable relative to and within the apparatus for generating an airflow to release and transport particles away from the area; and a particle collector that is rotatable with the member and relative to the apparatus, wherein the member comprises an airflow-generating surface arranged within the housing, said airflow-generating surface faces the area to be cleaned in the operating condition and is rotatable within the housing so as to cause a rotating airflow parallel to the area to be cleaned, wherein the airflow-generating surface is provided on a rotatable disc, and wherein the particle collector is provided for collecting the particles after their release from the area to be cleaned and comprises a chamber having a bottom wall, wherein the bottom wall comprises a flexible part, and in that a second opening is provided in the bottom wall and in the airflow-generating surface, wherein the flexible part allows a deflection of the bottom wall from a retaining position, in which the bottom wall of the chamber extends in an upward direction towards the second opening for collecting and retaining particles, into a releasing position, in which the bottom wall of the chamber extends in a downward direction towards the second opening for releasing particles.

2. A cleaning apparatus as claimed in claim 1, wherein the rotatable disc comprises rotor blades which extend towards the area to be cleaned in operating condition.

3. A cleaning apparatus as claimed in claim 1, wherein the flexible part comprises a ring of flexible material.

4. A cleaning apparatus as claimed in claim 1, wherein the housing has a circumferential edge comprising a plurality of baffles that are distributed along a perimeter of the edge, wherein each baffle extends in downward direction away from the edge and has a bouncing surface for bouncing off the particles carried by the airflow, the bouncing surface being positioned obliquely in relation to the perimeter of the edge for preventing particles from escaping from the housing.

5. A cleaning apparatus as claimed in claim 1, wherein the rotor blades extend from a face of the rotatable disc which faces the first opening.

6. A cleaning apparatus as claimed in claim 1, wherein the rotatable disc is the bottom wall of the chamber.

7. A cleaning apparatus as claimed in claim 1, wherein the rotatable disc is mounted to the bottom wall of the chamber.

* * * * *